United States Patent [19]

Fredrickson

[11] 4,109,047

[45] Aug. 22, 1978

[54] RUB-ON SECURITY CARDS

[75] Inventor: Donald M. Fredrickson, Williamsville, N.Y.

[73] Assignee: Moore Business Forms, Inc., Niagara Falls, N.Y.

[21] Appl. No.: 813,247

[22] Filed: Jul. 6, 1977

[51] Int. Cl.[2] ..... B41M 5/00; B41M 5/12

[52] U.S. Cl. ..... 428/307; 427/145; 35/9 G; 428/916

[58] Field of Search ..... 428/199.29, 306, 307, 428/915, 916, 213; 427/145; 35/9 G, 9 R, 9 E

[56] References Cited

U.S. PATENT DOCUMENTS

| | | | |
|---|---|---|---|
| 3,001,886 | 9/1961 | Shrewsbury et al. | 428/201 |
| 3,514,305 | 5/1970 | Taylor | 427/145 |
| 3,664,910 | 5/1972 | Hollie | 428/916 |
| 3,682,673 | 8/1972 | Manske | 35/9 G |
| 3,914,511 | 10/1975 | Vassiliades | 428/411 |
| 4,046,404 | 9/1977 | Treier | 282/27.5 |

*Primary Examiner*—William J. Van Balen

*Attorney, Agent, or Firm*—Watson, Cole, Grindle & Watson

[57] ABSTRACT

Articles in the form of multilayered cards which contain information invisibly printed between a support member and a top member. By rubbing the exposed surface of either the support member or the top member, the information is developed into visible information which can be viewed either through one of the members, i.e., when one of the members is composed of a transparent material, or by physical separation of the members. The multilayered cards are structured similarly to multilayered carbonless copy papers. The information is protected from premature, unauthorized development and detection due to the fact that development thereof creates a chemical change in the multilayered card which cannot be reversed.

36 Claims, 6 Drawing Figures

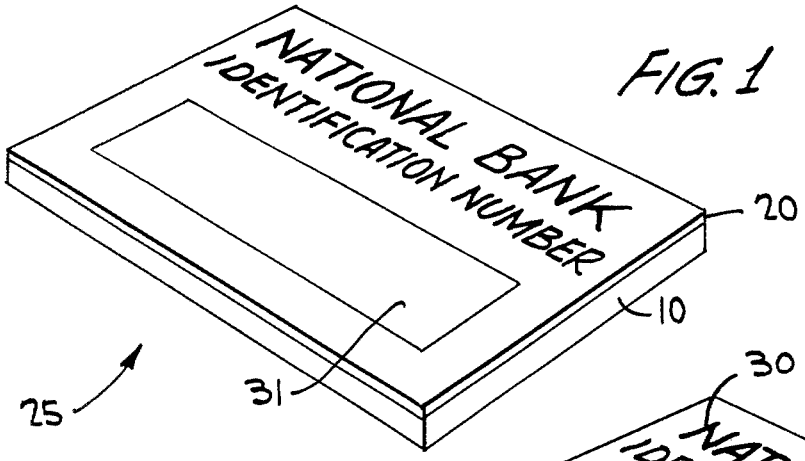
FIG. 1
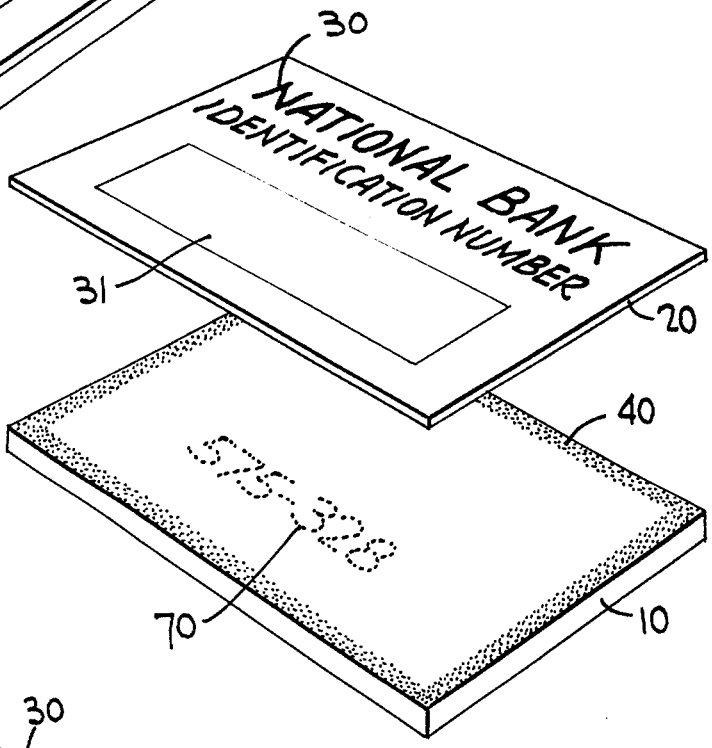
FIG. 2
FIG. 3
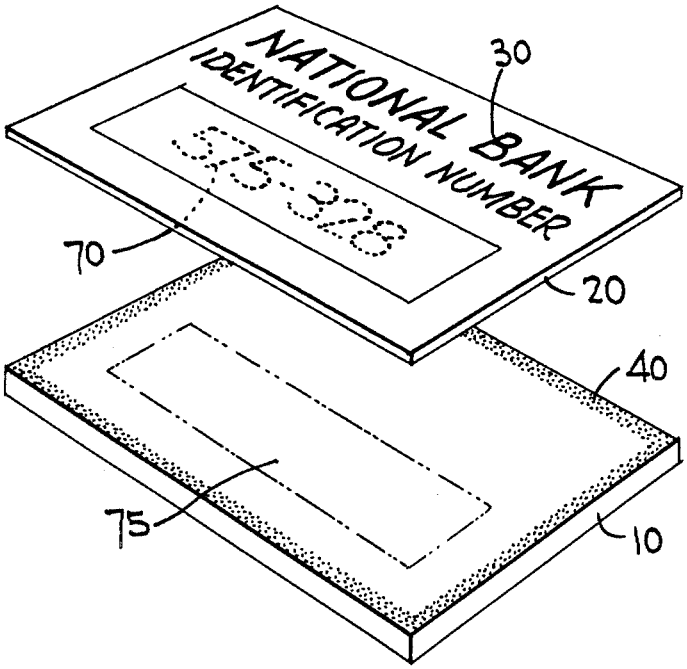
FIG. 4
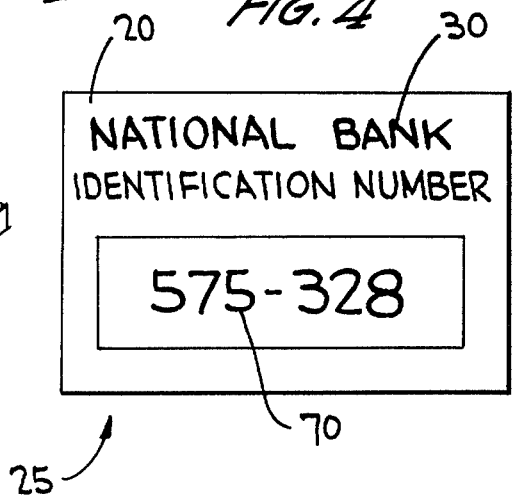

RUB-ON SECURITY CARDS

BACKGROUND OF THE INVENTION

1. Field of the Invention

The present invention relates to articles which contain information which is in safely concealed but readily accessible form. More specifically, the present invention relates to multilayered card products which contain information in invisible form, such as in the form of letters or numbers (indicia), which can be quickly developed into observable form, but only by causing an irreversible chemical change in the structure of the multilayered card.

2. Description of the Prior Art

The problem of maintaining recorded information secret is well known to the prior art and has resulted in the development of many schemes for protecting such information from discovery by unauthorized persons. Thus, for example, in the commercial world as well as in the conduct of military and diplomatic affairs, complicated codes have been developed whereby written information can be transmitted from one place to another. Other schemes have included the transmission of recorded information in a form ordinarily invisible to the naked eye, but which can be readily made visible or audible by special sensing mechanisms or chemicals.

However, in general these transmission methods do not have means for revealing whether or not the information being transmitted has been tampered with or exposed in it passage from source to destination. Moreover, many of the prior art transmission systems require elaborate technical procedures to render the information readable.

Commonplace situations wherein secret information transmission is utilized and wherein discovery of any tampering or unauthorized premature detection thereof is essential include banking transactions wherein a customer is issued a card containing a personalized, secret bank credit or debit number which allows the customer to "unlock" the bank's automatic teller computor located outside the bank's premises; ticket sales situations, such as game or lottery ticket sales, e.g., of the "instant winner" type, wherein the purchaser reads the secret information imprinted on or within the ticket to determine if he or she is an immediate winner; etc. Obviously, a critical aspect of these types of situations is an ability to readily determine whether or not the information contained on or within the issued article has been prematurely detected by an unauthorized person.

Turning now to the prior patents in this field, in Shrewsbury et al., U.S. Pat. No. 3,001,886 of Sept. 26, 1961, an article is disclosed for incorporating and transmitting concealed information which includes a foundation film (which may be transparent), an opaque metal coating thereover, a transparent layer upon which the intended indicia is visibly printed, a transparent overlayer, an opaque metal coating located over the overlayer, and finally a top, random pattern layer. In order to "read" the indicia, the random pattern layer and opaque metal coating thereunder must be removed by erasing, e.g., with an ordinary pencil eraser, in order to expose the underlying indicia. However, these articles are not completely safe from unauthorized premature detection: as inferred at the bottom of column 2 of this patent it is possible to closely duplicate the opaque metal coating with the proper equipment; and as noted at the top of column 3, if the original pattern of the top random pattern should be somehow closely reproduced (i.e., after unauthorized detection of the underlying indicia by removal thereof), the only possible way to discover this tampering is by comparing photographs of the new patterned coating with photographs of the original. Thus, it can be seen that the Shrewsbury et al article is not only complicated in manufacture, requiring the application of multiple metal layers as well as a top patterned layer to a foundation film, but the product is still susceptible to tampering without detection. In any event, detection of tampering may require photographs of the original top patterned layer which generally will not be available.

The prior art in fact lacks an easily manufactured card product which can have its concealed information readily exposed, but wherein any tampering therewith in order to discover the information contained therein is immediately detectable.

In the field of carbonless copy papers it is known to coat the backside of a suitable sheet material, such as a paper web, with a continuous layer of dye precursor-containing, pressure-rupturable microcapsules to form a CB (coated-back) sheet, and to place this sheet into appropriate contact with a continuously sensitized surface of a second sheet, called a CF (coated-front) sheet, and thereby form a carbonless multilayer copy system. The pressure produced by a suitable instrument on the front or exposed side of the CB sheet causes rupturing of the adjacent microcapsules on the backside of the CB and the ultimate formation of a colored image on the sensitized (or color-developer) coating on the CF which corresponds to the shape of image produced on the CB by the employed instrument. Such systems are disclosed, for example, in Green, U.S. Pat. No. 2,712,507; Macaulay, U.S. Pat. No. 3,016,308; and others.

In addition to the foregoing, it is known to apply the layer containing pressure-rupturable dye precursor-containing microcapsules to the backside of the CB sheet in predetermined zones, and to additionally correlate these zones with correspondingly sensitized zones on the CF sheet. Such a technique is taught by Vassiliades in U.S. Pat. No. 3,914,511 of Oct. 4, 1975. Thus, according to this patent, instead of continuously coating the backside of the CB sheet with a layer containing microcapsules and the frontside of the CF sheet with a layer containing a sensitized agent, only specific areas of the CB and CF are so coated. In this way the transfer of data from top sheet to bottom sheet is prevented in the uncoated areas (due to the absence of either or both of the reactant components necessary for such transfer). This system provides for an efficient and less expensive way for production of copy materials when preparing carbonless-type billing invoices wherein certain data is to be included in the top (CB) sheet but excluded on the bottom (CF) sheet. This system, however, does not have as its object, nor indeed can it be employed, for producing multilayered sheet products containing latent (invisible) information which can be instantaneously developed by the user or holder thereof.

According to Cormack et al., U.S. Pat. No. 2,777,780 of Jan. 15, 1957, it is known to prepare billing invoices by applying desensitizing compounds to selected areas of a bottom (CF) sheet, these sheets having been previously coated in a continuous fashion with a layer containing a sensitized electron-accepting color-developer compound, to prevent information transfer from CB to the CF sheet. The desensitizing compounds, which may include cationic quaternary salts, aliphatic or aryl amine acetates, amines and diamines of high molecular weight and substituted oxazolines, inactivate the electron-accepting compounds (which may include attapulgite, kaolin, bentonite, etc.). According to this patent, the desensitizing compounds are applied in solution form to the sensitized color-developer coating on the CF sheet by standard printing techniques. However, as with Vassiliades, this Cormack et al. product has only large block zones of the CF sheet desensitized such that information manually recorded on the top (CB) sheet by stylus impression will not instantaneously reproduced on the bottom (CF) sheet. Thus, as with Vassiliades, this system does not have as its object, nor is it even suggested therein to produce multilayered sheet products containing latent concealed information which can be instantaneously developed by the user or holder thereof.

In the Skinner patents, i.e., U.S. Pat. Nos. 3,363,336; 3,363,337 and 3,363,338, teaching devices are disclosed which comprise single work sheets which have their surfaces appropriately treated such that differing visual effects can be achieved when writing is attempted thereon. In one embodiment invisible chemicals are applied to the surfaces of the work sheets in patterns which represent the shape of letters or numbers, and when the student writes thereon (in an attempt to himself reproduce the appropriate letter or number) with pen containing a suitable coreactant chemical, the mark so made appears as a colored trace. In this way the student can immediately see the trace of the mark he has made and be reassured that he is tracing the letter or number in the correct fashion. The area adjacent to the so-treated (or untreated as the case may be) area is such that if the student's writing instrument strays into this area no mark or trace will appear. Thus the student will immediately realize that he has made a mistake in tracing the corresponding letter or numeral. However, these Skinner patents do not relate to multilayered sheet systems and are limited to either instantaneously displaying (nor not displaying as the case may be) a mark as it is written. No provision is made for the production of a multilayered sheet system which can contain latent, invisible information which can be instantaneously displayed by rubbing of the top or bottom sheets.

A variation of the Skinner concept is taught in Manske, U.S. Pat. No. 3,682,673, wherein a work sheet has coated thereon (in the shape of the desired letters or numbers) a DTO-type reactant which, when contacted with a suitable reactant-containing solution from a chemical pen, will produce a visible mark. The DTO-type reactant is applied to the work sheet by placing thereover a top sheet which has coated thereon a layer of microencapsulated DTO derivative, and by imprinting on the exposed surface of the top sheet to rupture the corresponding microcapsules thereunder, such that the DTO-type reactant is released and migrates to the work sheet. In this way, an invisible entry is formed on the work sheet. However, in order for this hidden entry to be developed, it must be contacted with a suitable coreactant chemical.

None of the foregoing patents, however, and no other patents known at the present time, teach or suggest the production of latent image-containing carbonless CB-CF multilayered copy systems wherein the image is contained internal to the multilayered sheets and is instantaneously developable by rubbing the exposed surface of either the CB or CF sheet. Thus, even though Shrewsbury et al (U.S. Pat. No. 3,001,886 which is referred to above), discloses the possibility of utilizing a substrate which includes globules or capsules which contain reactive substances that when released, react with other substances in the production of visible characters or symbols, no enabling disclosure is provided which specifically indicates how the substrate is constructed, how it operates, or how it can be produced.

Accordingly, it is a basic object of the present invention to produce articles which contain information which is in safely concealed but readily accessible form.

It is a further object of the present invention to produce multilayered articles in the form of cards or tickets which contain invisible information, for example, in the shape of letters or numbers (indicia), which can be revealed quickly, but only by causing an irreverible chemical change in the card product.

It is a further object of the present invention to produce the foregoing products which do not require the use of optical diffusion patterns or single or multiple obscuring metal covering layers.

It is a further object of the present invention to produce multilayered articles in the form of cards or tickets which can contain invisible information, which can be passed from one person to another or sold in suitable vending machines, and which can be formed from sufficiently strong materials that their shape and integrity will remain intact during their useful life.

It is a further object of the present invention to form the above-mentioned cards or tickets using materials well known in the field of carbonless copy papers.

SUMMARY OF THE INVENTION

The present invention involves a multilayered article which contains information which is initially invisible, but which is capable of becoming permanently visible in the shape of information-relaying indicia upon pressure treatment of the card. The article is constructed of a first layer, a second layer coextensively arranged in an overlying adjacent relationship to the first layer, a first color forming material disposed between the inner facing surfaces of the first and second layers which is capable of developing invisible information into visible form, a second color forming material disposed between the inner facing surfaces of the first and second layers which is capable of chemically interreacting with the first material in order to produce the information in visible form, at least one of the first and second materials being initially configured in a shape which corresponds to the shape of the information to be made visible. The first and second materials are caused to interreact chemically when one or both of the outer, exposed surfaces of the first and second layers are pressure treated, e.g., by manually rubbing, such that the materials are pressed into intimate contact.

According to the invention, the first color forming material may be an initially colorless color-developer composition printed or otherwise coated onto one of the inner facing surfaces of the first or the second layers so as to be configured in a shape which corresponds to the shape of the information to be made visible. In this case, the second color forming material may be an initially colorless, color precursor compound, itself either contained in a continuous layer coated onto the other of the inner facing surfaces of the first or second layers, or else coated onto the other of the inner facing surfaces in a mirror-image shape corresponding to, and in register with, the shape of the color developer compound. On the other hand, the first color forming material may be contained in a continuous layer coated onto one of the inner facing surfaces of the first or the second layers, and the second color forming material may be coated onto the other of the inner facing surfaces of the layers so as to be configured in the shape which corresponds to the shape of the information to be made visible.

Furthermore, according to the invention the first layer may be described as a support member and the second layer may be described as a top member. The support member may be composed of a material strong enough for long-term durability of the multilayered article. The top member may be composed of a transparent material such that the information, once visible, may be observed therethrough; on the other hand, both the support member and the top member may be composed of an opaque material, in which case the multilayered article is formed so that the support member and the top member can be easily separated for visual observation of the information (if in a visible state) therebetween.

The color-developer composition and the color precursor compound are caused to chemically interreact upon the application of sufficient pressure to the exposed surfaces of either or both of the support member and the top member to cause intimate contact therebetween, and regardless of the particular internal configuration of materials therebetwen, the invisible information is made visible by developing an observable color contrast.

Further objects, advantages, and features of the invention will be apparent in the arrangement and construction of the constituent parts in detail as set forth in the following discussion taken together with the accompanying drawings.

DESCRIPTION OF THE DRAWINGS

In the drawings,

FIG. 1 depicts an elevational isometric view of the one embodiment of a multilayered card according to the present invention;

FIG. 2 depicts an exploded isometric view of the card of FIG. 1 wherein the information to be developed is formed on one of the layers which forms the multilayered card;

FIG. 3 depicts an exploded isometric view of the card of FIG. 1 wherein the information to be developed is formed on the other of the layers which forms the multilayered article;

FIG. 4 depicts a top view of the card of FIGS. 2 or 3 after the external surface of either or both of the layers which form the multilayered card have been subjected to a pressure treatment (rubbing) and wherein the upper layer is transparent such that the developed information can be viewed therethrough;

DETAILED DESCRIPTION OF THE PREFERRED EMBODIMENTS

Figure 5:
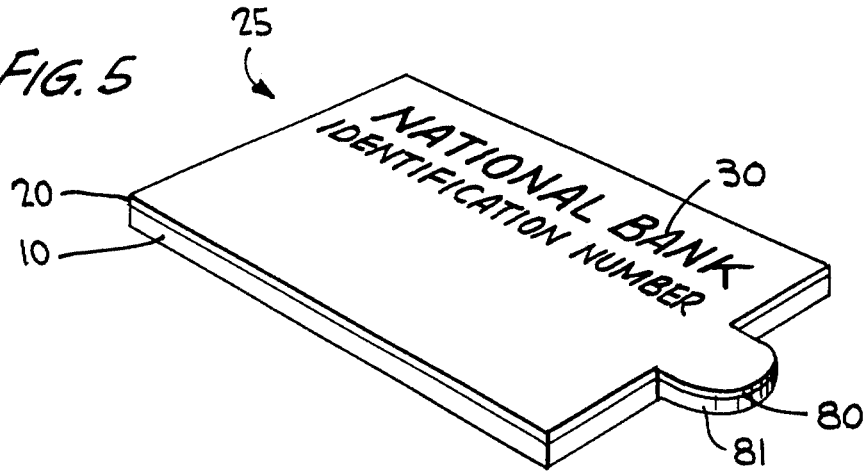
FIG. 5 depicts an elevational isometric view of a second embodiment of a multilayered card according to the present invention wherein both layers which for the multilayered card are both opaque and wherein tabs are connected to each of the layers for separation thereof after information development.

As can be seen from FIG. 1, the multilayered card of the present invention, which is generally indicated by reference numeral 25, comprises a first layer 10 and a second layer 20 which are arranged in a coextensive relationship with one another, second layer 20 being in an overlying adjacent relationship to the first layer 10. Although shown to have a rectangular configuration, the layers which form the multilayered card may have other configurations: square, oval, etc., as desired. In any event, the first and second layers normally have the same shape and dimensions. Printed information 30 is imprinted on the exposed surface of the second layer 20 to identify the use to which the card of the invention is directed, and a generally rectangular outline area 31 may be provided in which the information is to be observed. The article itself may be in the form of a ticket having dimensions suitable for placement in a wallet or shirt pocket, for example, and as shown in FIG. 1 the first layer 10 may be thicker than second layer 20, e.g., to provide an extra strength and stiffness to the card. In such a situation the first layer 10 may be considered to be a support member and the second layer 20 may be considered to be a top member.

The internal construction of one embodiment of a multilayered card as shown in FIG. 1 can be seen in FIG. 2. In this Figure the first layer 10 and the second layer 20 are shown in separated condition, and as shown at 40 a binder zone is utilized at the outer edges of, for example, the first layer 10, for attaching the respective edges of the first and second layers in unitary fashion as shown in FIG. 1. While this binder zone may be composed of a coating of a suitable bonding adhesive, other binder techniques could also be employed for attaching the edges of the first and second layers, e.g., hole punching, folded-over flaps, or other like techniques.

Shown at 70 in FIG. 2 is a representation of the information which is contained in the multilayered card of FIG. 1. The information is shown in dotted representation to indicate that it is in fact "invisible." This is the result of the fact that it is composed of a "colorless" material, i.e., a material which is either clear, or else of such a color that it is initially indistinguishable from the background color of the layer upon which it is coated. In other words, the term "colorless" within the scope of the present invention means that the material is such that it is initially indistinguishable in a visual sense from the color of the background against which it is to be observed. The information 70 is thus composed of an initially colorless color forming material, specifically either an initially colorless color-developer composition or an initially colorless color precursor compound, and is printed or otherwise coated onto the "inner" facing surface of first layer 10 to be positioned for ultimate display within the confines of rectangular outline area 31. The underside (i.e. when viewing FIG. 2) of second layer 20 is coated, at least in a zone corresponding to rectangular outline area 31, with a continuous layer of an initially colorless, color forming material which when pressed into intimate contact with the material forming information 70, can interreact chemically therewith to form a color which is distinct from the color of the material coated on second layer 20 and/or the color of the inner facing surface of first layer 10. Thus, if information 70 is formed by a color precursor compound, then the material coated on the underside of second layer 20 will be a color-developer composition, or vice versa. Since in FIG. 2 the second layer 20 is composed of a transparent material, upon the reaction of the color precursor compound and color-developor composition, the information will be observable through rectangular outline area 31.

FIG. 3 shows a second embodiment of a multilayered card as shown in FIG. 1. This card is similar to that shown in FIG. 2; however, in this embodiment the material is configured in a shape in the form of information 70 which has been printed or otherwise coated onto the inner facing surface of the second layer 20, and the material which is chemically reactive therewith is coated in a continuous fashion on the inner facing surface of the first layer 10 as shown as 75.

FIG. 4 depicts the multilayered card after either or both of the external surfaces of the first and second layers have been pressure treated, e.g. by rubbing, such that the color precursor compound and color-developer composition between the first and second layers have interreacted chemically. The areas indicated by 70 display a color which is different from the color of the adjacent areas and thus information 70 is observable within rectangular outline area 31 through transparent second layer 20.

Figure 6:
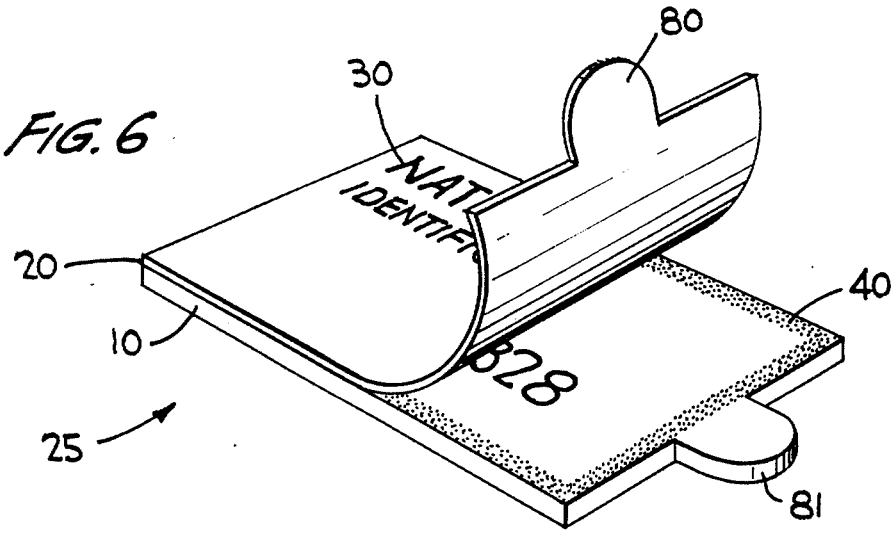
FIG. 6 depicts the card of FIG. 5 after information development and after the top layer has been partially separated from the bottom layer so as to expose to view the developed information between the layers.

FIG. 5 shows an embodiment of the multilayered card according to the present invention wherein a first tab 81 is connected to the first layer 10 and a second tab 80 is connected to the second layer 20. In this embodiment, both first layer 10 and second layer 20 are opaque, and thus in order to observe the development of information 70, second layer 20 must be separated from first layer 10. This is achieved by manually grasping tabs 80 and 81 and pulling them apart. A partially pulled-apart situation is depicted in FIG. 6.

Although not specifically shown in any of the drawings, the inner facing sides of the first layer 10 and the second layer 20 may be coated, e.g. in an area of each corresponding to area 31 shown in FIGS. 1–6 with continuous coatings of either a color precursor compound of a color-developer composition, and by printing or coating onto at least one of the continuous coatings a colorless desensitizing substance which is capable of preventing interreaction in the configured areas of the coatings in contact with the substance, e.g., by neutralizing either the color forming properties of the underlying color precursor compound and/or by neutralizing the color-developing properties of the underlying composition.

In operation the card of the invention, having been transferred to (hopefully) the intended recipient, is initially in the form as shown, for example, in either FIGS. 1 or 5 such that the information 70 is still in latent, invisible form between bound-together layers 10 and 20. Any unauthorized, premature development and detection of the information would be either immediately obvious by the observance of the information through transparent second layer 20 (as shown in FIG. 1) or by manually separating the first and second layers by means of, for example tabs 80 and 81, in order to see whether or not the information is visible (as in the FIG. 5 embodiment). Assuming that no prior development has taken place, then in order to develop the latent image, the exposed surface of either second layer 20, first layer 10, or both, are pressure treated, e.g. by rubbing, with a suitable force such that the color precursor compound and color-developer composition between the two layers will come into sufficient contact that a chemical interreaction therebetween will occur and produce a distinct color. In this regard, and when considering the FIGS. 2 and 3 embodiments of the invention, the information becomes observable due to the fact that the color produced by the chemical reaction is either different from the inherent color of the inner facing surface of first layer 10 (i.e., when the material coated onto the inner surface of second layer 20 is clear) or else is distinctly different from the specific color of the material coated onto the inner facing surface of second layer 20. On the other hand, when considering the embodiment of the invention wherein a colorless desensitizing substance is used, the information becomes observable due to the fact that the desensitized area retains its initial color (the desensitizing agent either acting as a barrier to reaction between the color precursor compound and the color-developer composition, or else neutralizing either the color forming properties of the color precursor compound or the color forming properties of the color-developer composition and thereby preventing a color formation), whereas the non-desensitized areas of the layers of color precursor compound and color-developer composition are allowed to react and produce a color different from the color within the desensitized area.

It should be noted that it is within the scope of the present invention for the first layer 10 to be transparent and for the second layer 20 to be opaque; however, in this embodiment the information would be suitably formulated within the layers in a mirror-image fashion to that shown in FIGS. 2 and 3.

In sum, it should be obvious from the foregoing that initially invisible information may be made visible in the shape of information-relaying indicia by pressure treatment of cards made according to the present invention wherein either color forming material may be placed on either layer in either the desired shape itself or in the mirror image of the desired shape depending upon whether the card is to be separated for reading or one of the layers is transparent for reading without separation. Moreover, either material may be placed on either layer in the form of an outline (or stencil presentation) of the desired shape or its mirror image.

When a desensitizer is used, it may be placed on either material in the desired shape, in the mirror image of the desired shape or in the form of an outline of the desired shape or its mirror image.

For purposes of the present invention, it should be understood that the direct shape, its outline or mirror image of either correspond to the shape of the message to be conveyed.

Also, when a desensitizer is placed on one of the coatings of material, the uncoated areas also have a shape which corresponds to such message. In some cases the corresponding shape is direct, in others it is the mirror image and in still others it is in outline form.

In addition, it should also be noted that means other than tabs 80, 81 (see FIG. 5) could be employed for separating the second layer 20 from the first layer 10. For example, one corner of the article 25 can be left free of binder 40 such that manual gripping of second layer 20 and separation thereof from first layer 10 can be achieved.

The first layer (or support member) 10 can be composed of any material which can provide sufficient strength and integrity for the intended use of the article. When the article is to be used as a bank card or game ticket, the first layer 10 should be of a "card weight", i.e., of sufficient weight that its "feel" would be suitable for manual handling of the article and storage in a wallet or other carrier regularly subjected to stresses. Specific materials include paper, cardboard, plastic, textile, metal, or any other materials suitable for the intended purpose.

The second layer (or top member) 20 can also be of any suitable material as long as it is either opaque or transparent in accordance with whether or not the card is to be of the type shown in FIG. 1 or the type shown in FIG. 5. Specific materials include paper, plastics, or any other material suitable for the intended purpose.

With regard to the make up of the printings or coatings of reactive materials and the color precursor compounds color-developer compositions which are utilized therein and with respect to the colorless desensitizing substances which can be used in the present invention article, such materials and agents, and the means for retaining these components onto the layers of the multilayered article are well known in the carbonless copy paper field.

For example, the reactive materials may be printed or coated onto one or the other of the first and second layers of the multilayered card in the form of dispersions within a solid, generally rigid, lattice of molecules of the type disclosed in U.S. Pat. No. 3,720,534 to Macaulay et al. In such a system intimate contact and chemical interreaction between the reactive materials is forestalled until a sufficient pressure is applied to the external surface of one or both of the first and second layers to cause an exudation of the occluded materials such that they become intermixed.

On the other hand, the reactive materials may be printed or coated onto one or the other of the first and second layers of the multilayered card in the form of liquid droplets contained within discrete, pressure-rupturable microcapsules which are themselves dispersed in a suitable binder. In such a system the interreaction between the reactive materials is forestalled until a sufficient pressure is applied to the external surface of one or both of the first and second layers to cause a rupturing of the microcapsule walls with the resultant intermixing and reaction between the respective materials. Such systems are well known in the carbonless copy paper field, for example, as shown in U.S. Pat. No. 2,712,507 to Green, U.S. Pat. No. 3,016,308 to Macaulay, etc.

The reactive materials themselves, i.e., the color precursor compounds and color-developer compositions are also well known in the carbonless copy paper field. More specifically, the color precursor compounds are normally electron-donator color-producing dye precursors which are initially colorless in nature. Such dye precursors are disclosed in the Green and Macaulay patents referred to above. Further reference is made to U.S. Pat. No. 3,455,721 to Phillips, Jr., et al (particularly to the compounds mentioned in the paragraph bridging columns 5 and 6); the fluoran-type color precursors disclosed in U.S. Pat. Nos. 3,501,331; 3,617,335; 3,669,711; 3,669,712; 3,697,540; 3,627,787; 3,681,390 and 3,725,416.

The foregoing color precursor compounds must be capable of undergoing an acid-base type reaction with an acidic material used as the color-developer composition. Of course, depending upon the specific embodiment of the multilayered card of the invention contemplated, the color-developer composition and binder therefore must be either initially clear or else of such an initial color that it blends in with the color of the background upon which it is coated. Other known color precursors include the spiro-dipyran compounds disclosed in Harport, U.S. Pat. No. 3,293,060 (particularly as noted from column 11, line 32 to column 12, line 21 therein).

When contained in microcapsules, the formation of the microcapsules takes place as follows: the color precursor compounds are dissolved in a solvent and the solution is encapsulated in accordance with the procedures and processes described and disclosed in Macaulay, U.S. Pat. No. 3,016,308 and Green U.S. Pat. No. 2,712,507. Other processes which can be used are disclosed in Ruus, U.S. Pat. No. 3,429,827 and Baxter, U.S. Pat. No. 3,578,605. In this connection, it should be appreciated that the exact nature of the capsule itself is not critical as long as the same is capable of containing the color precursor and can be ruptured by the application of pressure in accordance with conventional carbonless copying procedures. Solvents known to be useful in dissolving color presursors include chlorinated biphenyls, vegetable oils (caster oil, coconut oil, cotton seed oil, etc.), esters (dibutyl adipate, dibutyl phthalate, butyl benzyl adipate, benzyl octyl adipate, tricresyl phosphate, trioctyl phosphate, etc.), petroleum derivatives (petroleum spirits, kerosene, mineral oils, etc.), aromatic solvents (benzene, toluene, etc.), silicone oils, or combinations of the foregoing. Particularly useful are the alkylated naphthalene solvents disclosed in Konishi et al, U.S. Pat. No. 3,806,463.

The color-developer compositions useful in the present invention are those compositions which are capable of reacting with color precursor compounds of the invention to produce a specific color. Such compositions include those electron-acceptor compounds known in the prior art, e.g., the montmorillonite clay materials of Baxter, U.S. Pat. No. 3,963,852 and the acid-treated organic polymeric materials such as those disclosed in Phillips, Jr., et al, U.S. Pat. No. 3,455,721.

The desensitizer substances, used in one embodiment of the multilayered card of the present invention, are such that they prevent a color-forming reaction between the color precursor compound coated onto one to the layers of the card of the invention and the color-developer composition coated onto the other of the layers of the article of the invention. Such desensitizer substances will either act as a barrier so as to prevent intimate contact between the two agents, or else will act to neutralize the color forming properties of the color precursor compound or to neutralize the color forming properties of the color-developer compositions. Useful desensitizing agents include quaternary ammonium salts, aliphatic or aryl amine acetates, amines and diamines of high molecular weight and substituted oxazoline (as in Cormack et al., U.S. Pat. No. 3,777,780); citric acid, bleach and sodium chloride (as in Martino, U.S. Pat. No. 3,364,052); zinc salts (as in Ostlie U.S. Pat. No. 3,481,759); partial esters of ethylenediaminetetraacetic acid (as in Yarian, U.S. Pat. No. 3,809,668 and Yarian, U.S. Pat. No. 3,852,094); spiroacetal diamines (as in Miyamota et al., U.S. Pat. No. 3,900,218); tetramethyl ammonium chloride; and any other compound which could act as a desensitizing agent according to the present invention.

The information 70 can be imprinted onto the layers 10 and/or 20 by various printing techniques. For example, the coatings can be applied using a conventional flexo-coater system, a letter press system or a ink jet printer system. An especially preferred technique is to utilize a computer-controlled ink jet printer.

The coating steps for applying the various agents to the layers 1 and 2 can be accomplished either before or after the layers have been cut or formed into the desired size and shape. The adhesion strip 40 (as shown in FIG. 1 and which is applied to either the first or the second layer or both before the two are placed in contact) functions to either temporarily or permanently secure them together. Adhesion strip 40 can, as noted previously, be replaced with any other bonding means which can function to maintain the layers together.

It is readily apparent from the foregoing discussion that the multilayered articles of the present invention have a multitude of uses. Thus, the multilayered articles can be used as data-transmitting cards in bank transactions or in fact in any transactions wherein information of a secret nature is to be transmitted from one person to another, as lottery tickets, as educational or game cards, etc. Other applications will be apparent to those skilled in the art.

While there has been shown and described what is considered to a preferred embodiment of the present invention, it will be obvious to those skilled in the art that various changes and modifications may be made therein without departing from the invention as defined in the appended claims.

I claim:

1. A multilayered card which contains initially invisible information that is capable of becoming permanently visible in the shape of information-relaying indicia upon pressure treatment of the card, the construction of the card being such that any information development and detection by either an authorized or an unauthorized person becomes manifestly and permanently evident, said card comprising:

a first layer;

a second layer coextensively arranged in an overlying adjacent relationship to said first layer;

a first initially colorless, color developer composition disposed in a first continuous coating between the inner facing surfaces of said first and second layers; and a second initially colorless, color precursor compound disposed in a second continuous coating between said inner facing surfaces of said first and second layers adjacent said first continuous coating, said color developer composition and said color precursor compound being capable of interreacting chemically when pressed into intimate contact to produce a colored mark and being disposed to be pressed into such contact upon the application of pressure to an outer, exposed surface of at least one of said first and second layers;

and an initially colorless desensitizing substance disposed on one of said coatings in a configuration which presents said correspondingly configured material, said substance being capable of preventing said interreaction in the areas of said coatings in contact therewith to thus form said information-relaying indicia.

2. The card of claim 1 wherein said substance is on said second coating and functions by neutralizing the color forming properties of the underlying precursor compound.

3. The card of claim 1 wherein said substance is on said first coating and functions by neutralizing the color-developing properties of the underlying composition.

4. The card of claim 3 wherein said composition comprises an electron-acceptor component.

5. The card of claim 4 wherein said component is a reactive clay.

6. The card of claim 5 wherein said clay comprises an acid-treated bentonite.

7. The card of claim 4 wherein said compound comprises an electron-donor compound.

8. The card of claim 3 wherein said second coating comprises a multiplicity of minute, discrete pressure-rupturable microcapsules containing said compound.

9. The card of claim 3 wherein said substance comprises tetramethylammonium chloride.

10. The card of claim 1 wherein said first layer is opaque and said second layer is transparent.

11. The card of claim 10 wherein said opaque layer comprises a material which is thicker and stronger than the material comprising the transparent layer.

12. The card of claim 11 wherein said opaque layer comprises paper.

13. The card of claim 11 wherein said opaque layer comprises cardboard.

14. The card of claim 11 wherein said opaque layer comprises a textile.

15. The card of claim 11 wherein said opaque layer comprises a metal.

16. The card of claim 11 wherein said opaque layer comprises a plastic.

17. The card of claim 11 wherein said transparent layer comprises a plastic.

18. The card of claim 11 wherein said layers have the same general shape and dimensions.

19. The card of claim 18 wherein said layers are attached to one another at their respective edges.

20. The card of claim 19 wherein said layers are attached at said edges by a bonding adhesive.

21. The card of claim 11 wherein said first continuous coating is disposed on said opaque layer and said second continuous coating is disposed on said transparent layer.

22. The card of claim 10 wherein said first continuous coating is disposed on said transparent layer and said second continuous coating is disposed on said opaque layer.

23. The card of claim 11 wherein both of said layers are opaque.

24. The card of claim 23 wherein said first layer comprises a material which is thicker and stronger than the material comprising the second layer.

25. The card of claim 24 wherein said first layer comprises paper.

26. The card of claim 24 wherein said first layer comprises cardboard.

27. The card of claim 24 wherein said first layer comprises a textile.

28. The card of claim 24 wherein said first layer comprises a metal.

29. The card of claim 24 wherein said first layer comprises a plastic.

30. The card of claim 24 wherein said second layer comprises a plastic.

31. The card of claim 24 wherein said layers have the same general shape and dimensions.

32. The card of claim 31 wherein said layers are attached to one another at their respective corresponding edges.

33. The multilayered card of claim 32 wherein said layers are attached at said edges by a bonding adhesive.

34. The card of claim 32 further including means for separating said layers.

35. The card of claim 34 wherein said means comprises a tab connected to said first layer and a tab connected to said second layer.

36. The card of claim 32 wherein said layers are attached to one another along only a portion of their respective edges.

* * * * *